United States Patent [19]

Gerard et al.

[11] Patent Number: 4,668,407

[45] Date of Patent: May 26, 1987

[54] FIRE EXTINGUISHING COMPOSITION AND METHOD FOR PREPARING SAME

[76] Inventors: Mark P. Gerard, 211-16 82nd Ave., Hollis, N.Y. 11427; Laurence S. Gerard, 333 E. 66th St., New York, N.Y. 10021

[21] Appl. No.: 814,281

[22] Filed: Dec. 23, 1985

Related U.S. Application Data

[63] Continuation of Ser. No. 549,837, Nov. 9, 1983, abandoned.

[51] Int. Cl.[4] ..... A62C 1/14; A62C 13/20; A62D 1/08

[52] U.S. Cl. ..... 252/8; 169/9; 169/11; 169/46; 169/47; 252/2; 252/3

[58] Field of Search ..... 169/44, 46, 47, 65, 169/9, 11; 252/2, 3, 8

[56] References Cited

U.S. PATENT DOCUMENTS

| | | | |
|---|---|---|---|
| 2,818,382 | 12/1957 | Rotival | 252/8 |
| 2,921,897 | 1/1960 | Glendinning | 252/8 |
| 3,276,999 | 10/1966 | Petit et al. | 252/8 |
| 3,822,207 | 7/1974 | Howard et al. | 252/8 |
| 3,879,297 | 4/1975 | Languille et al. | 252/8 |
| 3,986,560 | 10/1976 | Heath et al. | 169/62 |
| 4,069,872 | 1/1978 | Lassen | 169/47 |
| 4,226,727 | 10/1980 | Tarpley, Jr. et al. | 252/8 |
| 4,226,728 | 10/1980 | Kung | 252/8 |
| 4,251,579 | 2/1981 | Lee et al. | 428/73 |
| 4,274,491 | 6/1981 | Tarpley, Jr. | 169/46 |
| 4,367,799 | 1/1983 | Tarpley, Jr. | 169/46 |

FOREIGN PATENT DOCUMENTS

| | | | |
|---|---|---|---|
| 0740662 | 4/1970 | Belgium | 252/8 |
| 0750304 | 11/1970 | Belgium | 252/8 |
| 1492735 | 8/1967 | France | 252/8 |
| 0110700 | 8/1979 | Japan | 252/8 |
| 1298337 | 11/1972 | United Kingdom | 252/8 |

OTHER PUBLICATIONS

Breen, D., 1975, Combinations of Halons 1301 and 1211 as Fire Suppressants, prepared for E. I. du Pont de Nemours & Co., Inc.

Breen, D., 1977, Interactions in Binary Halon Mixtures Used as Fire Suppressants, Fire Technology 13(4):261-266.

Research Disclosure #13536, Jul. 1975, entitled "Fire Extinguishers Containing Halogenated Hydrocarbon".

Kuhlmann, U., 1970, Pyroforane Fire Extinguishing Agents (Pyroforane brochure).

*Primary Examiner*—John F. Terapane
*Assistant Examiner*—Howard J. Locker
*Attorney, Agent, or Firm*—Lieberman, Rudolph & Nowak

[57] ABSTRACT

There is disclosed, in one aspect, a dispensable flame-extinguishing composition comprising approximately 5 to approximately 20 percent by weight bromotrifluoromethane and approximately 95 to approximately 80 percent by weight bromochlorodifluoromethane and a residual air weight at 70° F. which varies inversely to the degree of vacuum pulled under constant volume. For vessels ranging in size from 127 mls. to 325 mls. at a temperature of 70° F. the amount and weight of residual air will vary from approximately 0.047 grams to 0.390 grams for a 22" Hg vacuum to no vacuum being pulled. The composition utilizes residual air to dispense the extinguishing agents in the temperature range of −40° F. to room temperatures. In another aspect, there is disclosed a method for extinguishing fires. This method comprises applying to the fire the above-described composition. This composition is particularly useful in hand-held fire extinguishers.

10 Claims, No Drawings

FIRE EXTINGUISHING COMPOSITION AND METHOD FOR PREPARING SAME

This application is a continuation, of application Ser. No. 549,837, filed 11/9/83 now abandoned.

BACKGROUND OF THE INVENTION

This invention relates generally to fire extinguishing compositions, particularly those which may be used in handheld, portable fire extinguishers, and to methods of extinguishing fires.

Fire extinguishing compositions are well known. These compositions are applied to a fire to extinguish the fire to various degrees of effectiveness depending upon the particular composition used. Gaseous fire extinguishing compositions are also well known. There exists, for example, a fire extinguishing composition comprising bromochlorodifluoromethane as the extinguishing agent (or extinguishant) and nitrogen gas as the expelling agent (or expellant). The use of such a composition also requires the presence of a pressure gauge on the fire extinguisher to detect leaks of the nitrogen gas or bromochlorodifluoromethane into the atmosphere. The leakage problem is particularly acute with nitrogen gas because of the relatively small size and weight of this molecule as compared to bromochlorodifluoromethane.

The use of a pressure gauge on a portable, hand-held fire extinguisher which is designed primarily for household use is particularly undesirable not only because of the added expense involved in supplying each fire extinguisher with a pressure gauge, but also because of the practical difficulty involved in attaching a pressure gauge and still having a portable, hand-held, inexpensive, yet effective, fire extinguisher for home use.

The use of bromotrifluoromethane as a fire extinguishant is also well known. This compound is relatively much more expensive than bromochlorodifluoromethane. For that reason alone, the use of bromotrifluoromethane in a fire extinguishing composition is not preferred. The use of combinations of bromotrifluoromethane and bromochlorodifluoromethane as fire suppressants has been reported. Breen, David E. "Combinations of Halons 1301 and 1211 as Fire Suppressants" in *Factory Mutual Research Technical Report,* May, 1975.

The use of bromotrifluoromethane and bromochlorodifluoromethane as an extinguishing composition in a relatively small fire extinguisher was described by Kung in U.S. Pat. No. 4,226,728.

The use of non-fluorocarbon propellants, e.g. propane, or inert gas additives, e.g. carbon dioxide or nitrogen, as propellants for effective dispensing is well known. Propellants are used especially at very low temperatures, for example, −40° F.

The search has continued for a portable, hand-held, inexpensive fire extinguisher which contains a composition which will effectively be dispensed at a wide range of temperatures to extinguish fires but which does not require the use of a pressure gauge to determine gas leaks or propellants for effective dispensing. This invention was made as a result of that search.

OBJECTS AND SUMMARY OF THE INVENTION

Accordingly, it is a general object of the present invention to avoid or substantially alleviate the above-described problems of the prior art.

A more specific object of this invention is to provide a fire extinguishing composition which, when used in a fire extinguisher does not require a pressure gauge on the fire extinguisher.

Another object of the present invention is to provide a fire extinguishing composition which is safe, effective, and inexpensive to manufacture, a method for its manufacture, and a method for its use.

A further object of the present invention is to provide a flame extinguishing composition dispensed at a wide range of temperatures without requiring the addition of non-fluorocarbon or inert gas propellants where wide range of temperatures is defined as a range extending from −40° F. to 130° F., with the upper limit of 130° F. being derived from U.S. Department of Transportation "DOT Specification 2Q" for aerosol cans, wherein the Department of Transportation requires that all aerosol containers, which are transported, not exceed a pressure of 180 psi-gauge at a temperature of 130° F.

Other objects and advantages of the present invention will become apparent from the following summary of the invention and description of its preferred embodiments.

The present invention provides, in one aspect, a composition for extinguishing fires. This composition comprises from about 05 to about 25 percent by weight bromotrifluoromethane and from about 95 to about 75 percent by weight bromochlorodifluoromethane.

In another aspect, the present invention provides a method for adding the described composition to a fire extinguishing container. This method comprises first the evacuation of the extinguishing container which varies in capacity from 127 mls. to 325 mls. using an 18" Hg to 22" Hg vacuum and then the addition of the composition which compresses the residual air.

DESCRIPTION OF THE PREFERRED EMBODIMENTS

The composition of the present invention may be used to extinguish fires. This composition comprises bromochlorodifluoromethane and bromotrifluoromethane. Both of these compounds are gases at room temperature. Bromotrifluoromethane functions primarily as an expellant and secondarily as an extinguishant in this composition whereas bromochlorodifluoromethane functions primarily as an extinguishant.

Both compounds are well known and available commercially. HALON 1301 bromotrifluoromethane is a low-boiling, colorless liquified compressed gas having a high density and low viscosity. It is available commercially frOm the E. I. duPont de Nemours & Co. It has a molecular weight of 148.9, a boiling point (at atmospheric pressure) of −72° F., a freezing point (at atmospheric pressure) of −270.4° F., a critical temperature of 152.6° F., a critical pressure of 575.0 psia, a critical density of 46.5 pounds/cubic foot, and a heat of vaporization of 47.7 BTU/pound at the boiling point.

HALON 1211 bromochlorodifluoromethane is commercially available from I.C.I. United States, Inc., and has a molecular weight of 165.4. This compound has a boiling point of 25° F., a freezing point of −256° F., a critical temperature of 309° F., a critical pressure of 596 psia, a critical density of 44 pounds/cubic foot, and a heat of vaporization of 57 BTU/pound at one atmosphere.

The relative amounts of each compound that are used in the composition may be generally from about 05 to about 20, typically from about 15 to about 20, and preferably about 20 percent by weight bromotrifluoromethane, and correspondingly generally from about 95 to 80, typically from about 85 to about 80, and preferably about 80 percent by weight bromochlorodifluoromethane based upon the total weight of the composition. Amounts of bromotrifluoromethane substantially in excess of about 20 percent by weight are undesirable because of the fact that bromotrifluoromethane is so much more expensive than bromochlorodifluoromethane that a practical, economic composition would not result as well as to a high pressure. Amounts of bromotrifluoromethane substantially less than about 05 percent by weight also should not be used since such compositions would have insufficient expellant to expel sufficient extinguishing agent to extinguish the fire.

The method of preparing a fire extinguisher, without non-fluorocarbon or inert gas propellants, is first to evacuate the apparatus using an 18"-22" Hg vacuum, preferably an 18" Hg Vacuum. Evacuation of a 325 ml. capacity container employing an 18" Hg vacuum leaves 123.60 mls. or 0.148 grams of residual air in the container; a 20 Hg vacuum leaves 110.53 mls. or 0.133 grams of residual air in the container; and, a 22" Hg vacuum leaves 97.5 mls. or 0.117 grams of residual air in the container. A fire extinguisher can be prepared without first evacuating the apparatus, leaving the 325 mls. or 0.390 grams of residual air in the container. The bromotrifluoromethane—bromochlorodifluoromethane blend liquid is then added to the can. The average partial air pressure of the filled unit in the case of the 18" Hg vacuum is 12.3 psi; for the 20" Hg vacuum 11.0 psi; and, for the 22" Hg vacuum 9.7 psi. The described method, through control of the headspace volume of the apparatus and the degree of evacuation, can be manipulated to various fire extinguishing requirements.

Evacuation of a 127 ml. capacity container employing an 18" Hg vacuum leaves 55.09 mls. or 0.066 grams of residual air in the container; a 20" Hg vacuum leaves 44.34 mls. or 0.053 grams of residual air in the container; and, a 22" Hg vacuum leaves 39.27 mls. or 0.04714 grams of residual air in the container. If no vacuum is applied then 127 mls. or 0.1525 grams of residual air remain in the container. As described above, the extinguishant is added after the can is evacuated. The average partial air pressure of the filled unit in the case of the 18" Hg vacuum is 16.4 psi; for the 20" Hg vacuum 13.9 psi; and, for the 22" Hg vacuum 4.4 psi. These two examples indicate that if the volume capacity of the headspace is held constant, the partial air pressure would decrease as the degree of evacuation would increase.

The composition of the present invention may be used in any fire extinguishing apparatus which employs gaseous extinguishants such as bromotrifluoromethane and bromochlorodifluoromethane. Such apparati include hand-held, portable fire extinguishers and automatic extinguishing systems. This composition is particularly preferred for hand-held, portable, aerosol type fire estinguisher for home use.

In practice, the composition is sprayed through one or more nozzles of a fire extinguisher onto a fire for a sufficient time to extinguish the fire or expel the contents of the fire extinguishing apparatus, whichever comes first.

The present invention is further illustrated by the following examples. All parts and percentages in the examples as well as in the specification and claims are by weight unless otherwise specified.

EXAMPLES 1-6

Six compositions comprising HALON 1211 bromochlorodifluoromethane and HALON 1301 bromotrifluoromethane were mixed in the amounts set forth in Table I and the compositions were added as described above to a nozzle spray hand-held, portable fire extinguisher and used to extinguish a 7BC fire, i.e., a fire which is prepared by placing 1.5 inches of heptane on top of 6 inches of water in a 2.5 square foot container, igniting the heptane, and allowing it to pre-burn for 30 seconds. The fire extinguisher itself was at ambient temperature and pressure although the composition was, of course, pressurized. The extinguisher was held 3.5 feet from the fire.

The time needed to extinguish the fire as well as the total number of grams of composition dispensed are set forth in Table I. The tests were conducted outdoors.

TABLE I

| Example | (grams) 1211 | (grams) 1301 | # Grams Dispensed | Time (Seconds) to Extinguish Fire |
|---|---|---|---|---|
| 1 | 320.17 | 80.57 | 201.05 | 6.90 |
| 2 | 320.74 | 82.09 | 215.66 | 5.60 |
| 3 | 320.47 | 81.23 | 375.61 | 10.80 |
| 4 | 360.70 | 41.60 | 341.80 | 15.50 |
| 5 | 360.80 | 39.90 | 379.40 | failed |
| 6 | 360.60 | 39.00 | 306.00 | 17.00 |

It is believed that example 5 failed to extinguish the fire due to the wind conditions under which the test was run.

The pressure of the compositions at various temperatures are set forth in Table II.

TABLE II

| Example | Temperature | Pressure (psig) |
|---|---|---|
| 1 | −40° F.+ | 2 |
| 1 | X | 0 |
| 2 | −40° F.+ | 2 |
| 2 | X | 8 |
| 3 | 70° F.+ | 67 |
| 3 | X | 69 |
| 4 | −40° F.+ | 0 |
| 4 | X | 2 |
| 5 | 70° F.+ | 50 |
| 5 | X | 53 |
| 6 | −40° F.+ | 0 |
| 6 | X | 3 |

By "−40° F.+" is meant that the fire extinguisher containing the composition was cooled to −40° F. using dry ice and then the extinguisher was removed from the dry ice and a pressure gauge was attached to measure the pressure of the composition. The temperature of the composition increased somewhat during the short period of time it took to attach the pressure gauge to the extinguisher. The "+" indicates this slight (unknown) temperature increase.

By "X" is meant the temperature of the fire extinguisher when it is removed from the temperature controlled atmosphere to ambient temperature for sixty seconds. For example, "X" in Example 1 refers to the temperature of the fire extinguisher sixty seconds after removal from the −40° F. controlled temperature whereas "X" in Example 3 refers to the temperature of the fire extinguisher sixty seconds after removal from the 70° F. controlled temperature.

The pressure data in Example 1 most likely reflects experimental error since there is apparently a pressure decrease with a temperature increase.

The data in Tables I and II indicate a fire extinguishing composition which is effective at very low temperatures, much lower than those ordinarily experienced in the home. Furthermore, the compositions of the present invention are useful in a hand-held, portable fire extinguisher without the use of expensive pressure gauges and propellants. The molecular weights of each of the gaseous compounds involved are approximately six times the molecular weight of nitrogen so that any leakage may be readily determined by simply weighing the fire extinguisher with the composition and comparing that weight with its gross weight upon sealing during manufacture.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in this art without departing from the spirit of the invention. In particular, variations may be made in the degree of evacuation, the vapor pressure of the extinguishant added and the volume of the container which provides an extinguishant which is readily dispensed without addition of an expellant.

What is claimed is:

1. A containerized dispensable composition, dispensible over a range of temperatures, for extinguishing fires and contained within an extinguisher having no pressure measuring gauge, said composition consisting of from about 5 to about 20 percent by weight bromotrifluoromethane, from about 95 to about 80 percent by weight bromochlorodifluoromethane and air, said air being the residual air left after evacuating said extinguisher prior to filling and having a residual air weight at 70° F., which varies inversely to the degree of vacuum pulled under constant volume and wherein said extinguisher does not contain a separate propellant to expel said composition, said extinguisher operable to dispense said dispensable composition at −40° F. and to extinguish a fire of predetermined size and wherein said residual air weight would vary from 0.117 grams to 0.148 grams for evacuation of a 325 ml. capacity container using a 22" to 18" Hg vacuum respectively, and wherein said dispensable composition within said fire extinguisher does not exceed a pressure of 180 psi-gauge at a temperature of 130° F.

2. The containerized dispensable composition of claim 1 wherein the residual air weight varies from 0.066 grams to 0.047 grams for evacuation at 127 ml. capacity container using an 18" to 22" Hg vacuum, respectively.

3. The containerized dispensable composition of claim 1 wherein said composition comprises from about 15 to about 5 percent by weight bromotrifluoromethane and from about 95 to about 80 percent by weight bromochlorodifluoromethane and a residual air weight at 70° F. which varies inversely to the degree of vacuum pulled under constant volume.

4. The containerized dispensable composition of claim 1 wherein said composition comprises about 20 percent by weight bromotrifluoromethane and about 80 percent by weight bromochlorodifluoromethane and a residual air weight at 70° F. which varies inversely to the degree of vacuum pulled under constant volume.

5. The containerized dispensable composition of claim 1 wherein said composition is used in a hand-held fire extinguisher.

6. A method for extinguishing a fire by applying to said fire without the use of a separate propellant a containerized composition consisting of from about 5 to about 20 percent bromotrifluoromethane from about 95 to about 80 percent by weight bromochlorodifluoromethane and air, said air being the residual air left after evacuating said extinguisher prior to filling and having a residual air weight at 70° F. which varies inversely to the degree of vacuum pulled under constant volume, said extinguisher operable over a wide range of temperatures to dispense said dispensable composition at −40° F. and to extinguish a fire of predetermined size and wherein said residual air weight would vary from 0.117 grams to 0.148 grams for exacuation of a 325 ml. capacity container using a 22" to 18" Hg vacuum respectively, and wherein said dispensable composition within said fire extinguisher does not exceed a pressure of 180 psi-gauge at a temperature of 130° F.

7. The method of claim 6 wherein the residual air weight varies from 0.066 grams to 0.047 grams for evacuation of a 127 ml. capacity container using an 18" to 22" Hg vacuum respectively.

8. The method of claim 6, wherein said containerized composition comprises from about 15 to about 5 percent by weight bromotrifluoromethane and from about 95 to about 80 percent by weight bromochlorodifluoromethane and a residual air weight at 70° F. which varies inversely to the degree of vacuum pulled under constant volume.

9. The method of claim 6, wherein said containerized composition comprises about 20 percent by weight bromotrifluoromethane and a residual air weight at 70° F. which varies inversely to the degree of vacuum pulled under constant voluem.

10. The method of claim 6, wherein said containerized composition is used in a hand-held fire extinguisher.

* * * * *